US005984648A

United States Patent [19]

Stopyra et al.

[11] Patent Number: 5,984,648

[45] Date of Patent: Nov. 16, 1999

[54] RETAINER FOR POWER CORD

[75] Inventors: Stephen Stopyra, Syracuse; Theodore S. Bolton, Liverpool, both of N.Y.

[73] Assignee: Carrier Corporation, Farmington, Conn.

[21] Appl. No.: 09/017,069

[22] Filed: Feb. 2, 1998

[51] Int. Cl.[6] ..... F04B 17/00

[52] U.S. Cl. ..... 417/423.14

[58] Field of Search ..... 417/423.14, 423.1, 417/410.1, 321; 174/157, 168; 24/155 R, 585, 129 A, 136 R, 115 H

[56] References Cited

U.S. PATENT DOCUMENTS

| | | | |
|---|---|---|---|
| 281,541 | 7/1883 | Mather | 24/712.1 |
| 293,689 | 2/1884 | Usborne | 188/65.3 |
| 679,829 | 8/1901 | Carr | 24/131 R |
| 3,813,501 | 5/1974 | Meletti et al. | 191/12.2 R |
| 4,566,748 | 1/1986 | Tanishi et al. | 339/95 D |
| 4,944,689 | 7/1990 | Carr | 439/417 |
| 5,243,138 | 9/1993 | Guthke et al. | 174/146 |
| 5,669,119 | 9/1997 | Seron | 24/265 H |
| 5,751,135 | 5/1998 | Fukushima et al. | 320/107 |
| 5,807,313 | 9/1998 | Delk et al. | 604/35 |
| 5,820,395 | 10/1998 | Hashizawa | 439/271 |

*Primary Examiner*—Philip H. Leung
*Assistant Examiner*—Daniel L. Robinson
*Attorney, Agent, or Firm*—Wall Marjama Bilinski & Burr

[57] ABSTRACT

Apparatus for retaining electrical cords of varying thickness within an open top channel. Retaining members are mounted alternately on each of the side walls of the channel each having steps that include a top step adjacent the bottom wall of the channel and a bottom step adjacent the open top of the channel. A service cord having a first thickness can be friction fitted between the top step of each member and the opposite side wall of the channel. Similarly a service cord having a greater thickness can be friction fitted between the bottom step of each member and the opposite side wall of the channel.

12 Claims, 6 Drawing Sheets

RETAINER FOR POWER CORD

BACKGROUND OF THE INVENTION

This invention relates to apparatus for retaining electrical cords having different cross-sectional areas within a confined area, and, in particular, to an electrical cord retaining system suitable for use in an air handling unit containing a blower and an electrical control section.

More specifically, this invention relates to an electrical cord retaining apparatus for use in a portable air purification unit. Most portable air purification units are contained within closed housings wherein the component parts of the unit are tightly packed together. As a result, the electrical service cord used to bring power to the electrical control section of the unit must be securely confined so that it will not come in contact with the moving parts of the unit. In addition, the cord must be able to withstand a pull test of 35 pounds without failing.

Many air handling units having different electrical demands are packaged in the same housings using many common component parts. Accordingly, depending upon the electrical demand of the system, the cross-sectional size of the electrical cord servicing the units can change. A different cord retainer is therefore normally required to accommodate each of the various size cords.

SUMMARY OF THE INVENTION

It is therefore a primary object of the present invention to improve apparatus for retaining electrical service cords inside a housing along with other components.

A further object of the present invention is to provide an electrical cord retaining system suitable for use in an air handling unit which will prevent the cord from being entangled in the moving parts of the unit.

A still further object of the present invention is to provide an electrical service cord retaining device that is capable of securely retaining electrical cords having varying cross-section dimensions within a housing.

Another object of the present invention is to provide an electrical service cord retaining system for use in association with a portable air purification unit that is able to withstand a pull test of at least thirty five pounds without failing.

These and other objects of the present invention are attained by apparatus for retaining electrical cords of different cross-sectional dimensions within a housing containing an air purification unit having a blower. The blower wheel is contained within a scroll along with an electrical control section. An arcuate-shaped, open top channel is mounted adjacent to the scroll that has a first and second side walls and a bottom wall. A series of cord retaining members are spaced apart along the length of the channel and each member contains a series of steps. The members are mounted alternately on the opposed side walls with the top step of each member being adjacent to the bottom wall of the channel and the bottom step of the member being adjacent to the open top of the channel. A service cord of a given size is retained on each member between one of the steps and the opposing side wall of the channel. Because the members are mounted alternately on the side walls of the channel, the cord passing through the channel assumes a serpentine posture thus strengthening its ability to resist being pulled out of the unit.

BRIEF DESCRIPTION OF THE DRAWINGS

For a better understanding of these and other objects of the present invention, reference will be made to the following detailed description of the invention which is to be read in association with the following drawings, wherein.

DESCRIPTION OF THE INVENTION

Figure 1:
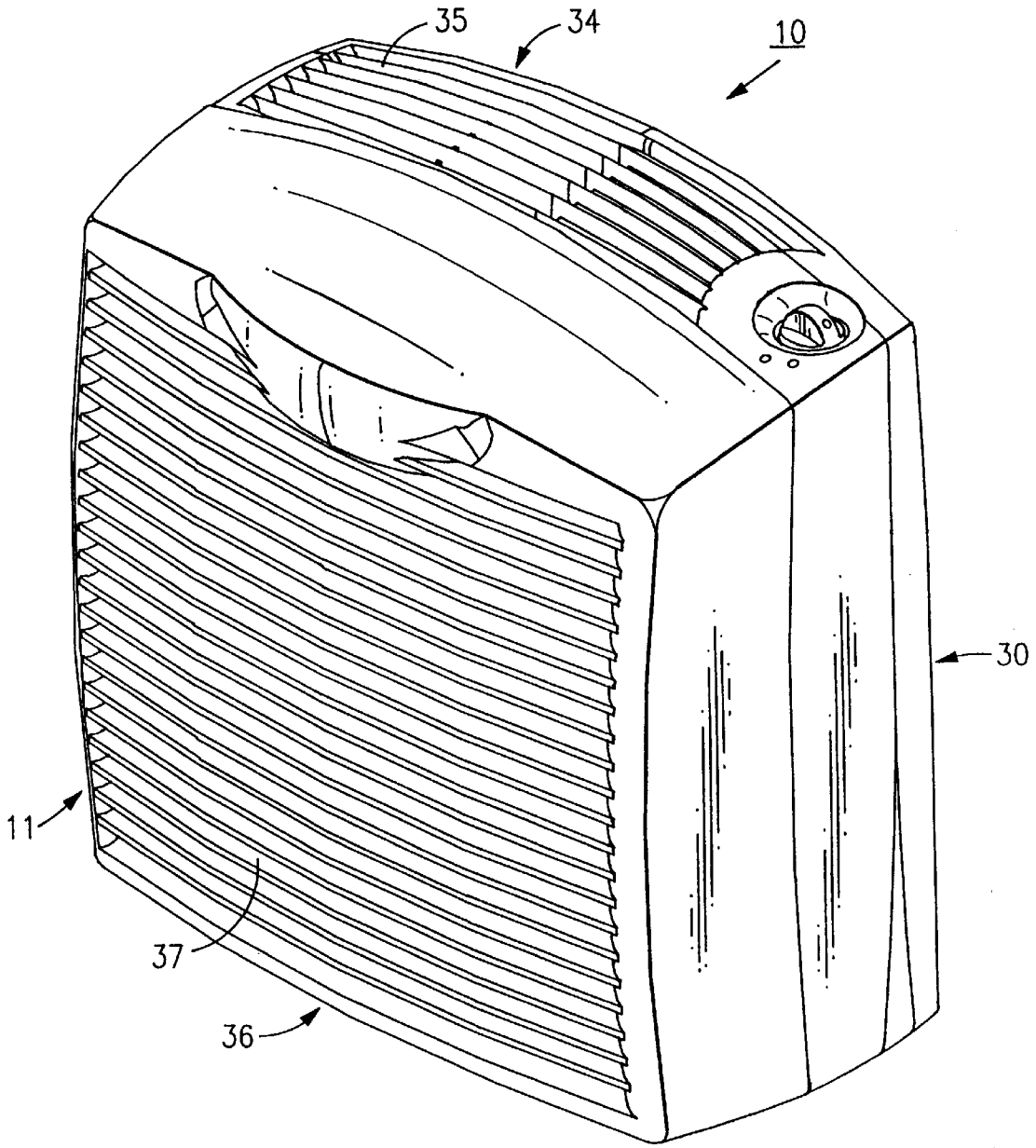
FIG. 1 is a perspective view of an air purifying unit embodying the teachings of the present invention.
Figure 2:
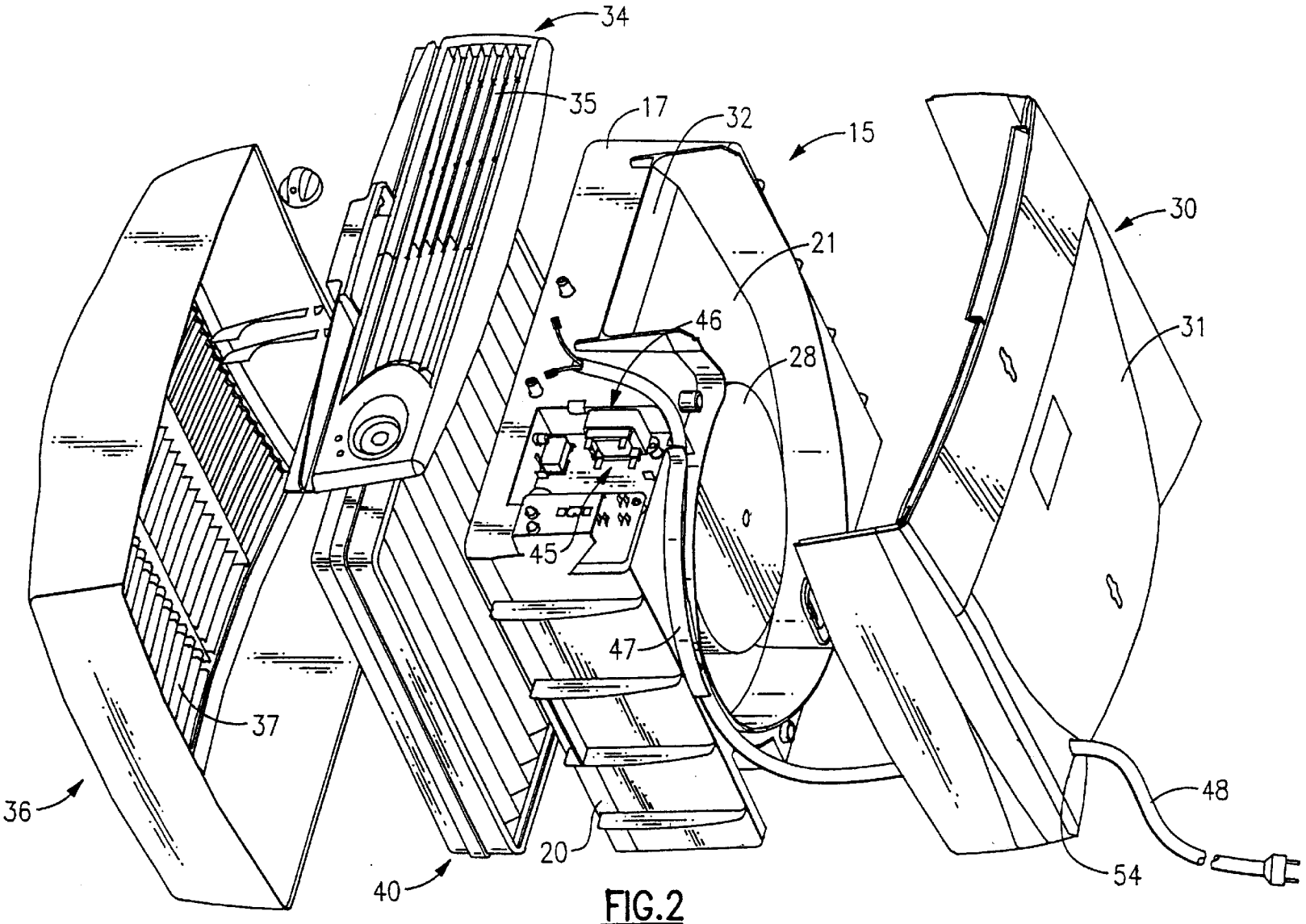
FIG. 2 is an exploded view in perspective showing the component parts of the unit illustrated in FIG. 1.
Figure 3:
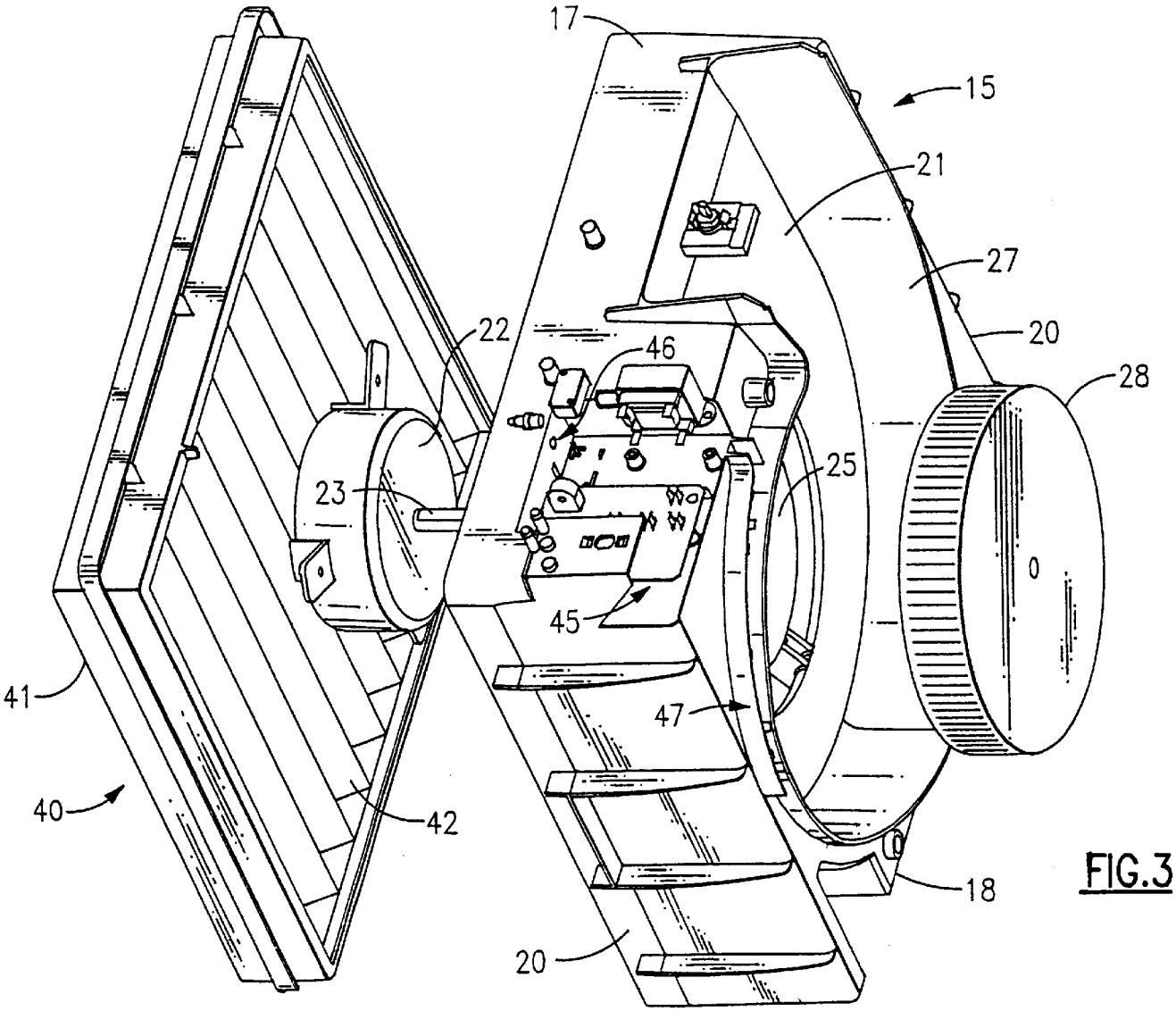
FIG. 3 is an enlarged, exploded view of the main support member of the unit which contains a blower system and an electrical component for servicing the blower.

Turning initially to FIGS. 1–3, there is shown an air purification unit, generally referenced 10, that is enclosed within a housing 11. The housing contains a main support member 15 upon which are mounted the component parts of the air purifying system along the housing covers. The support member is rectangular in form and includes a top wall 17, a bottom wall 18 and a pair of side walls 20. An interior wall 21 is mounted inside the support member 15 and is integrally molded to the other walls to provide a high strength member.

A blower motor 22 is mounted on the front face of the interior wall and the motor shaft 23 passes through an orifice 25 formed in the interior wall. A scroll 27 is molded into the back face of the interior wall and houses a fan 28 that is affixed to the blower motor. A rear cover 30 is secured to the back of the support member and includes a back panel 31 that closes the back of the scroll and an air discharge opening 32 in the top wall of the support frame.

A top cover 34 is secured to the top wall of the support member which contains an air outlet vent 35. A front access cover 36 placed over the front of the support member 15 and the top cover to completely enclose the unit. The front access cover is removably retained on the main support member to provide ready access to the internal components o the unit. The front access cover contains an air inlet vent 37 through which air is drawn into the housing by the blower system.

A filter assembly, generally referenced 40, is mounted over the front of the support frame. The assembly includes a mounting frame 41 containing a HEPA filter pack 42 for removing contaminants from the air stream being drawn through the housing.

Figure 4:
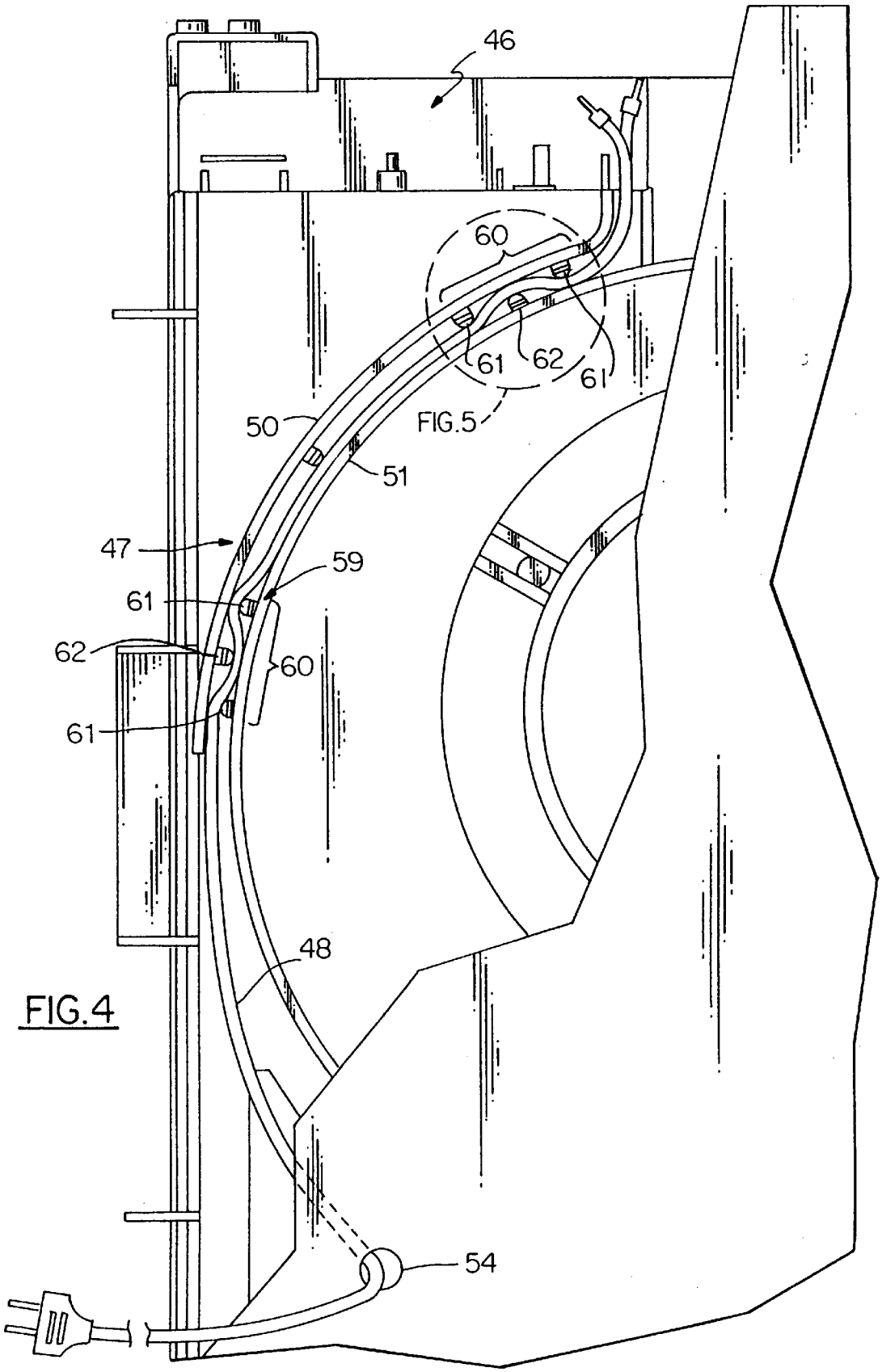
FIG. 4 is a further enlarged, partial rear elevation of the main support member with the electrical components removed for clarity.

With further reference to FIGS. 4–8, electric components generally referenced section 45 are contained within a recessed bay 46 molded into the top wall 17 of the support member. The bay houses the electrical components of the system needed to operate and control the blower. A rectangular service cord retaining channel 47 is molded in the back face of the interior wall of the support frame through which an electrical service cord 48 for providing power to the electrical components passes. The channel is arcuate along its length and is adapted to pass around the outside of the scroll. The channel has an open top 49 to permit the service cord to be inserted into the channel and a pair of opposed side walls 50 and 51 and a bottom wall 52. As illustrated in FIG. 4, one end of the service cord passes out of the channel into the electrical bay and is connected to the components contained in the bay. For the sake of clarity, the electrical components are not shown in FIG. 4. The opposite end of the service cord passes out of the channel and exits the housing through a hole 54 provided in the bottom of the rear cover.

As noted above, different capacity units can be mounted within the same housing which typically demands the use of service cords having different cross-sectional areas. If the cord is too thin, it can easily fall out of the channel, particularly when the housing is moved from place to place. On the other hand, if the cord is too thick, it cannot be safely inserted into the channel. Similarly, if the retaining channel is designed to restrain one size cord, an entire new support member would have to be provided for each different capacity unit. As will be explained in greater detail below, the channel of the present invention is designed so that it can accommodate cords of varying thicknesses while at the same time securely retaining the cords within the channel and preventing the cords from being pulled out of the units under acceptable loads.

Figure 5:
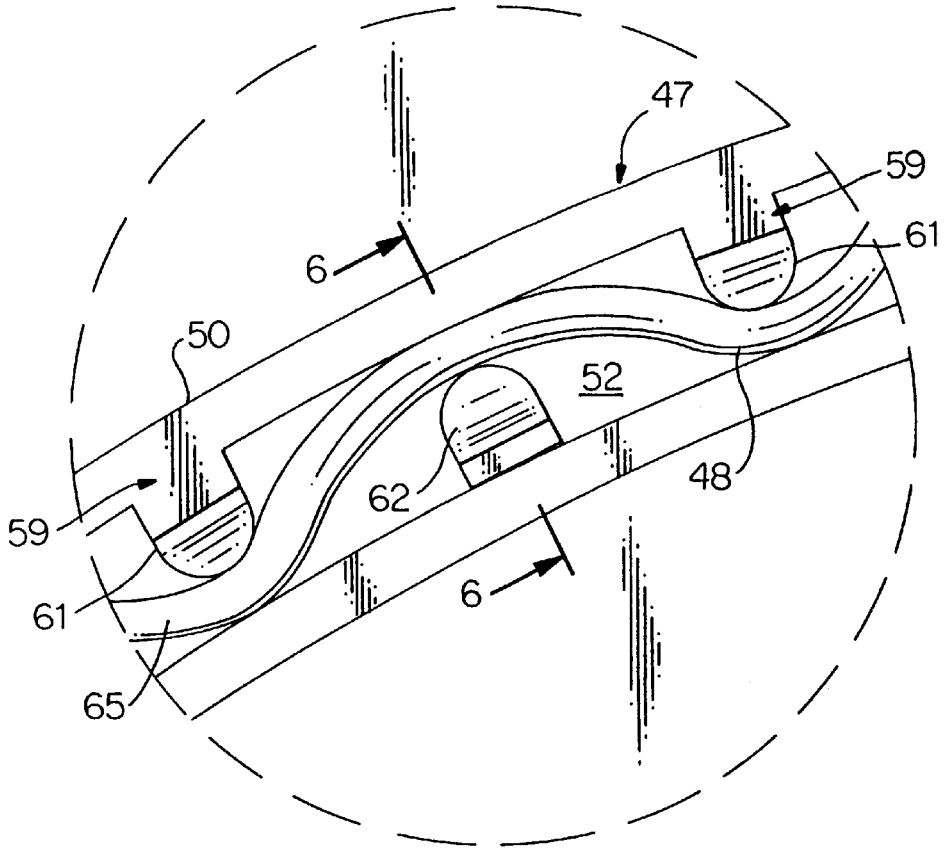
FIG. 5 is a partial rear view of the cord retaining channel associated with the main support frame.
Figure 6:
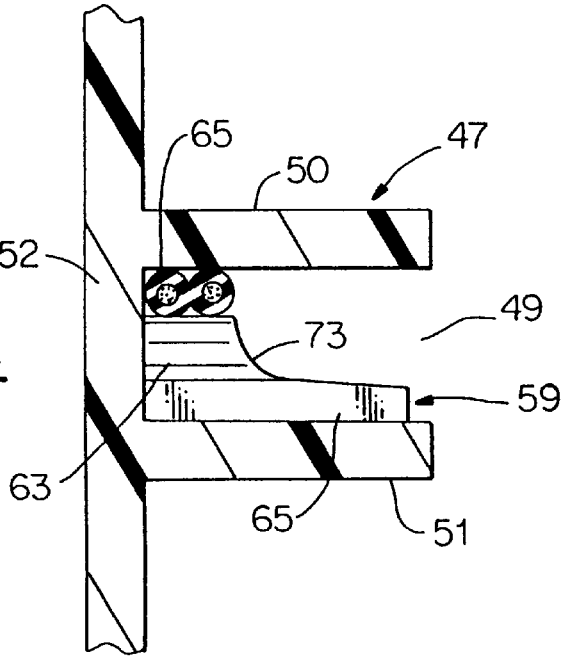
FIG. 6 is a section taken along lines 6—6 in FIG. 5 showing a small diameter cord being retained within the channel.

As illustrated in FIGS. 5 and 6, a plurality of stepped retaining members 59 are mounted inside the channel at spaced intervals along the length of the channel. Preferably, the members are grouped together in units 60 of threes with each unit containing a pair of outer members 61 and a center member 62 mounted about midway between the two outer members. Each member contains a top step 63 that is located adjacent to the bottom wall 52 of the channel and a bottom step 65 that is located adjacent to the top opening 49 in the channel. As illustrated, the members are staggered along the length of the channel so that each successive member is mounted on an opposite side wall of the channels all of which combine to establish a cord retaining unit. Accordingly, the outer members 61 are mounted on side wall 50, while the center member is mounted upon side wall 51.

A relatively thin service cord 65 is shown in FIGS. 5 and 6 mounted in the channel seated upon the top step 63 of each retaining member 59. The space afforded between the top step and the opposite side wall of the channel is such that the cord must be friction-fitted between the top step of each restraining member and the opposing wall of the channel thus tightly securing the cord within the channel. As illustrated in FIG. 5, the retaining members are mounted in each unit close enough together so that the cord forms a series of small radius arcs as it moves over the steps in each unit which again helps to keep the cord retained within the channel and strengthens its ability to resist being pulled out of the housing. The units are spaced apart along the channel at a relatively greater distance than the spacing being maintained between the retaining member contained within each unit. A single retaining member is mounted midway between the units which again further helps retain the cord in the channel and prevent pull out.

Figure 7:
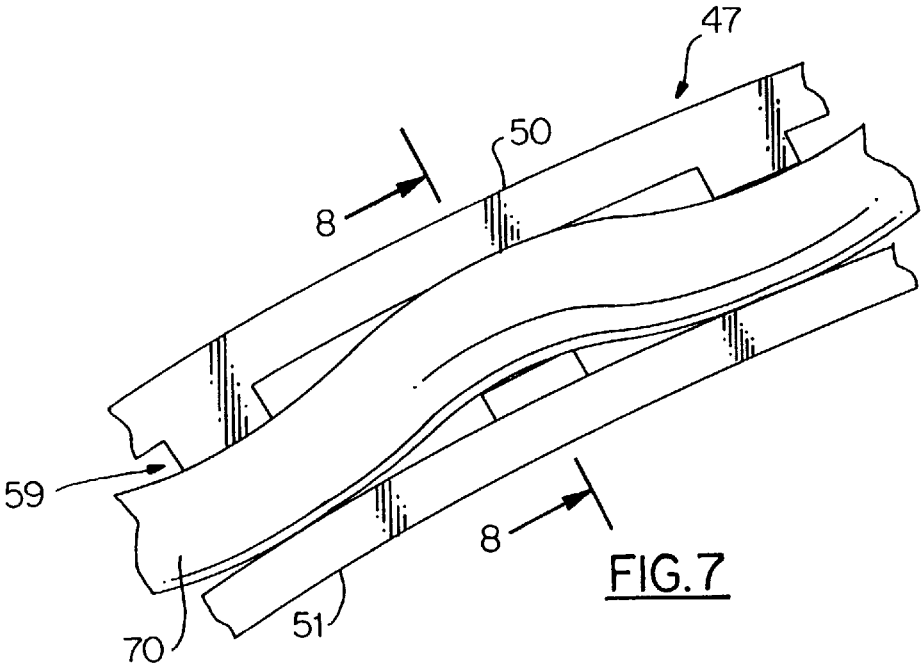
FIG. 7 is a partial rear view of the channel showing a large diameter cord being retained therein.
Figure 8:
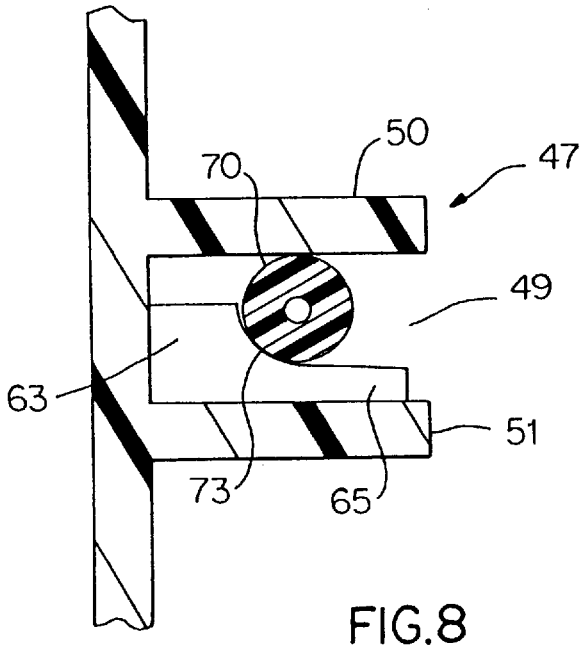
FIG. 8 is a section taken along lines 8—8 in FIG. 7.

FIGS. 7 and 8 illustrate a relatively thick service cord 70 passing through the channel. In this case the cord is seated upon the bottom step of each retaining member and as explained above, is pressed between the step and the opposing side wall of the channel to hold the cord securely inside the channel. The riser 73 between the two steps is arcuate in form and compliments the general shape of the service cord.

Although the retaining members described herein have only two steps, it should be obvious to one skilled in the art that more steps might be utilized when required to accommodate any desired number of service cords of varying thicknesses. It should also be noted that the retaining member do not have to be mounted in units of three but can be simply spaced apart along the length of the channel with each successive member being alternately mounted on the opposing side walls of the channel.

While this invention has been explained with reference to the structure disclosed herein, it is not confined to the details set forth and this invention is intended to cover any modifications and changes as may come within the scope of the following claims:

What is claimed is:

1. Apparatus for retaining electrical cords having different cross sectional areas within a confined space that includes:

an elongated open top channel having first and second opposed side walls and a bottom wall, a cord retaining means mounted inside said channel containing spaced apart cord retaining members, said members being mounted alternately on the first and second side walls of the channel each member having steps that include a top step adjacent the bottom wall of the channel and a bottom step adjacent the open top of the channel, whereby an electrical cord having a first thickness passing through said channel can be retained between the top step of each member and an opposing side wall of the channel and an electrical cord having a second greater thickness can be retained between the bottom step of each member and a side wall of said channel.

2. The apparatus of claim 1, wherein retaining units are equally spaced along the length of said channel.

3. The apparatus of claim 1 wherein the members are mounted in groups of threes along the length of the channel with each group containing two other members mounted on one side wall and the center member mounted on the other side wall.

4. The apparatus of claim 3, wherein a retaining member is also mounted midway between each group of members.

5. The apparatus of claim 4, wherein the steps of each retaining member are joined by a riser.

6. The apparatus of claim 5, wherein said riser is arcuate in form to compliment the shape of a cord seated upon the bottom step.

7. The apparatus of claim 1, wherein said channel is arcuate shaped.

8. Apparatus for retaining electrical cords of different sizes within an air purifying machine containing a blower that includes:

a scroll means containing a blower fan housing and an electrical control section, an arcuate shaped open top channel adjacent to the fan housing, that leads into the electrical section, said channel having first and second side walls and a bottom wall whereby electrical cords having different cross sectional areas can be conducted along the channel into the electrical section, a plurality of spaced apart retaining members mounted inside said channel each member having stops that include a top step adjacent the bottom wall of the channel and a bottom step adjacent the open top of the channel, said retaining members being alternately mounted upon opposite side walls of said channel.

9. The apparatus of claim 8, that further includes a rear cover mounted upon said scroll means over said channel.

10. The apparatus of claim 9, wherein said rear cover has an opening through which a cord positioned in said channel passes and further includes a fastening means for securing the cord to the scroll means adjacent to the opening in the rear cover.

11. The apparatus of claim 10, wherein each retaining member includes a plurality of progressively higher steps, and the steps being joined by risers.

12. The apparatus of claim 11, wherein each riser is arcuate shaped to compliment the shape of a cord seated upon one of the steps.

* * * * *